US009482419B2

(12) United States Patent
Yotsumoto et al.

(10) Patent No.: US 9,482,419 B2
(45) Date of Patent: Nov. 1, 2016

(54) ELECTRIC LIGHT BULB TYPE LIGHT SOURCE APPARATUS

(71) Applicant: SONY CORPORATION, Tokyo (JP)

(72) Inventors: Naoki Yotsumoto, Tokyo (JP); Kouji Miyata, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 376 days.

(21) Appl. No.: 14/483,394

(22) Filed: Sep. 11, 2014

(65) Prior Publication Data

US 2015/0028740 A1 Jan. 29, 2015

Related U.S. Application Data

(63) Continuation of application No. 13/687,246, filed on Nov. 28, 2012, now Pat. No. 8,847,491.

(30) Foreign Application Priority Data

Jan. 6, 2012 (JP) ..... 2012-001088

(51) Int. Cl.

| | |
|---|---|
| ***F21V 23/00*** | (2015.01) |
| ***F21V 33/00*** | (2006.01) |
| ***F21V 23/02*** | (2006.01) |
| ***H05B 33/08*** | (2006.01) |
| ***H05B 37/02*** | (2006.01) |
| ***F21K 99/00*** | (2016.01) |

(52) U.S. Cl.

CPC ..... *F21V 23/026* (2013.01); *F21K 9/135* (2013.01); *F21V 33/0056* (2013.01); *H05B 33/08* (2013.01); *H05B 33/0806* (2013.01); *H05B 37/0245* (2013.01); *Y10S 362/80* (2013.01)

(58) Field of Classification Search

CPC ..... F21Y 2101/02; F21Y 2105/001; F21Y 2111/005; F21Y 2103/003; F21Y 2113/005; F21Y 2111/02; F21Y 2111/004; H01L 31/052; F21K 9/135; F21K 9/13; F21K 9/1355; H05B 37/00; H05B 37/0245; H05B 2201/10106

USPC ..... 362/86–88, 253, 800, 230, 234, 362/249.02–249.06, 650, 651

See application file for complete search history.

(56) References Cited

U.S. PATENT DOCUMENTS

| | | | | |
|---|---|---|---|---|
| 8,282,227 | B2 * | 10/2012 | Massara et al. | 362/86 |
| 2004/0105264 | A1 * | 6/2004 | Spero | 362/276 |
| 2008/0225510 | A1 * | 9/2008 | Rocha | 362/86 |
| 2009/0207607 | A1 * | 8/2009 | Haase et al. | 362/234 |
| 2011/0037387 | A1 * | 2/2011 | Chou et al. | 315/35 |
| 2011/0050124 | A1 * | 3/2011 | Bailey et al. | 315/294 |
| 2012/0086345 | A1 * | 4/2012 | Tran | 315/158 |

* cited by examiner

*Primary Examiner* — Dedei K Hammond
(74) *Attorney, Agent, or Firm* — Chip Law Group

(57) ABSTRACT

An electric light bulb type light source apparatus includes a light source unit, a power source substrate, a drive substrate, a base, and a casing. On the power source substrate, a power source circuit is mounted, and the power source substrate has one of a through hole and a cutout. On the drive substrate, a drive circuit of at least the light source unit is mounted, and the drive substrate includes a part disposed in the one of the through hole and the cutout of the power source substrate. The base is used to supply power to the power source substrate. The casing is configured to contain the light source unit, the power source substrate, and the drive substrate, and the casing has a translucent cover.

10 Claims, 6 Drawing Sheets

ELECTRIC LIGHT BULB TYPE LIGHT SOURCE APPARATUS

This application is a continuation of U.S. patent application Ser. No. 13/687,246 filed on Nov. 28, 2012, which claims priority from Japanese Patent Application 2012-001088 filed in the Japan Patent Office on Jan. 6, 2012. Each of the above referenced applications is hereby incorporated by reference in its entirety.

BACKGROUND

The present disclosure relates to an electric light bulb type light source apparatus.

As an electric light bulb type lighting apparatus, Japanese Patent Application Laid-open No. 2008-193189 (hereinafter, referred to as Patent Document 1) discloses a lighting apparatus equipped with a speaker. The lighting apparatus is provided with a cylindrical casing, a speaker provided on the center of a front surface of the casing, and a plurality of LED (light emitting diode) elements disposed around the speaker on the front surface of the casing. Further, in the casing, as a control means, a circuit substrate is provided on which various circuits such as drive circuits for the LEDs and the speaker and circuits for radio communication are formed or mounted (see, for example, paragraphs 0011, 0014 to 0017 in the specification and FIG. 1 of Patent Document 1).

SUMMARY

However, to actually use such a lighting apparatus by a user, it is necessary to downsize an entire apparatus. In the lighting apparatus disclosed in Patent Document 1, although components including a power source circuit and the drive circuits are contained in the casing, creative arrangements and configurations of those components are necessary in consideration of the size of a lighting apparatus which can be used realistically.

In view of the above-mentioned circumstances, it is desirable to provide an electric light bulb type light source apparatus capable of achieving the downsizing by arranging components efficiently in a space having a small capacity.

According to an embodiment of the present disclosure, there is provided an electric light bulb type light source apparatus including a light source unit, a power source substrate, a drive substrate, a base, and a casing.

On the power source substrate, a power source circuit is mounted, and the power source substrate has one of a through hole and a cutout.

On the drive substrate, a drive circuit of at least the light source unit is mounted, and the drive substrate includes a part disposed in the one of the through hole and the cutout of the power source substrate.

The base is used to supply power to the power source substrate.

The casing is configured to contain the light source unit, the power source substrate, and the drive substrate, and the casing has a translucent cover.

In the present disclosure, the power source substrate has the through hole or the cutout, and the casing contains the power source substrate and the drive substrate so that the part of the drive substrate is disposed in the through hole or the cutout. As a result, it is possible to efficiently dispose the components in a small containing space in the casing, which can achieve the downsizing of the electric light bulb type light source apparatus.

The electric light bulb type light source apparatus may further include a speaker and a speaker drive substrate. On the speaker drive substrate, a drive circuit of the speaker is mounted, and the speaker drive substrate is contained in the casing and includes a part disposed in the one of the through hole and the cutout of the power source substrate. The speaker drive substrate is also disposed in the through hole or the cutout of the power source substrate like the drive substrate, thereby making it possible to achieve the space saving of the disposition of those.

The speaker drive substrate and the drive substrate may be provided as a common substrate so that the drive circuit of the speaker is mounted on the drive substrate. By providing the speaker drive substrate and the drive substrate as a common substrate, it is possible to achieve the downsizing of the electric light bulb type light source apparatus.

The electric light bulb type light source apparatus may further include a control substrate on which a control circuit that receives a radio signal from an outside of the electric light bulb type light source apparatus is mounted and which is contained in the casing and includes a part disposed in the one of the through hole and the cutout of the power source substrate.

The control substrate and the drive substrate may be provided as a common substrate so that the control circuit is mounted on the drive substrate. By providing the control substrate and the drive substrate as a common substrate, it is possible to achieve the downsizing of the electric light bulb type light source apparatus.

The electric light bulb type light source apparatus may further include a support unit configured to support the light source unit and the power source substrate so that the power source substrate is disposed between the light source unit and the base, the support unit including a part disposed in the one of the through hole and the cutout of the power source substrate. A part of the support unit that supports the light source unit and the power source substrate is disposed in the through hole or the cutout of the power source substrate, so it is possible to achieve the space saving of not only the disposition of the substrates but also the disposition of the support unit.

The power source substrate may include a first surface opposed to the base and a second surface which is provided on an opposite side to the first surface and opposed to the light source unit. In this case, the power source circuit may include a transformer including a primary side coil and a secondary side coil and a primary side electronic component electrically connected to the primary side coil, and the transformer and the primary side electronic component may be mounted on the first surface of the power source substrate. An insulating transformer and the primary side electronic component of the power source circuit are relatively large electronic components. On the first surface of the power source substrate, which is the base side, those components are disposed, and the light source unit is disposed on a space on the second surface side in the casing, thereby making it possible to effectively use the small space in the casing.

The electric light bulb type light source apparatus may further include a receiving unit configured to receive an infrared signal transmitted from a remote controller used by a user, the receiving unit being mounted on the drive substrate. As a result, it is possible to control the electric light bulb type light source apparatus with the remote controller.

The drive substrate may be disposed to cross the power source substrate via the one of the through hole and the cut out of the power source substrate.

The light source unit may include one of an LED (light emitting diode) and an EL (electro luminescence) element as a light source element.

As described above, according to the embodiments of the present disclosure, it is possible to achieve the downsizing by arranging the components efficiently in the space having the small capacity.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, an embodiment of the present disclosure will be described with reference to the drawings.

(Overall Structure of Electric Light Bulb Type Light Source Apparatus)

Figure 1:
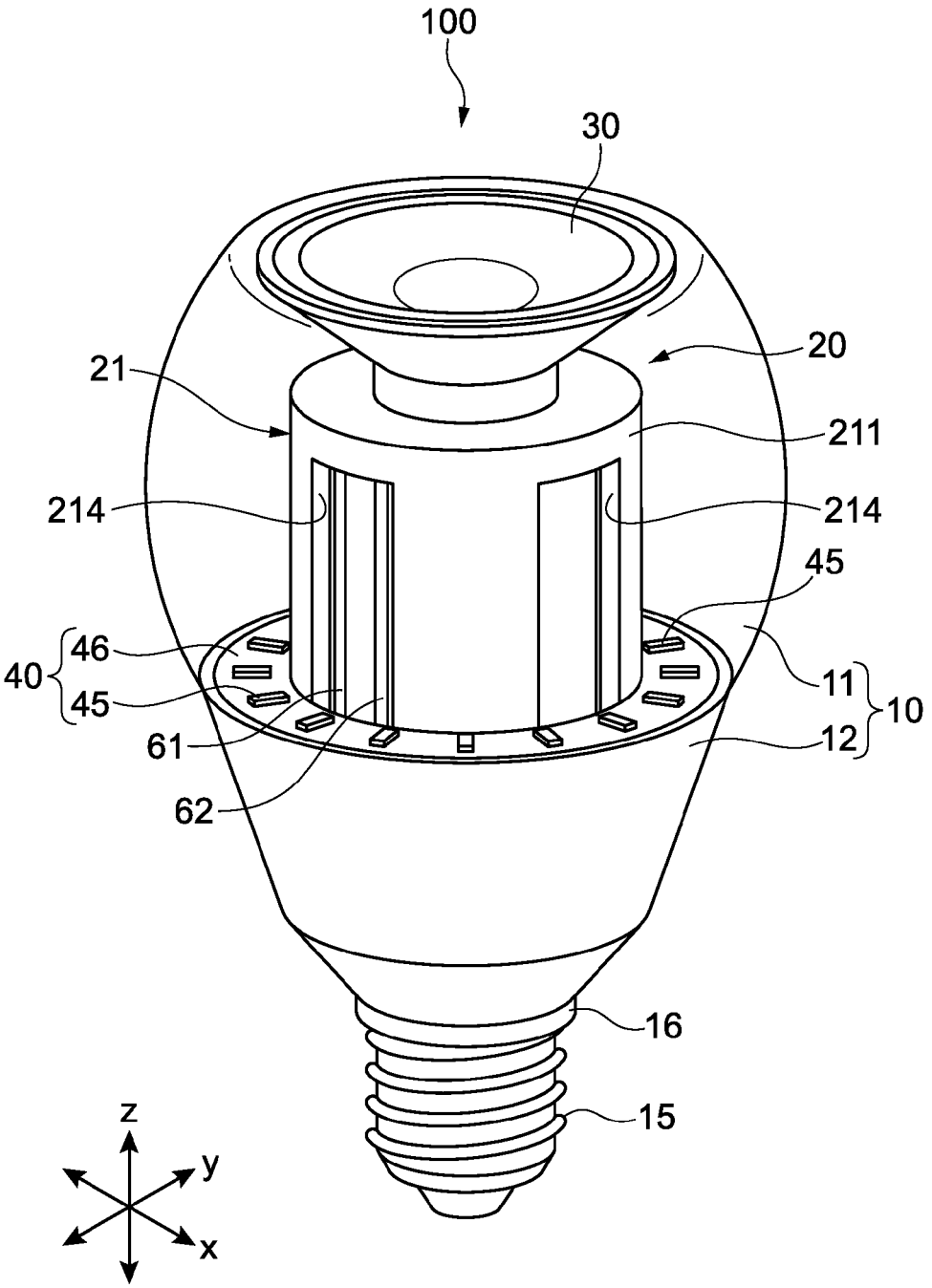
FIG. 1 is a perspective view showing an electric light bulb type light source apparatus according to an embodiment of the present disclosure.
Figure 2:
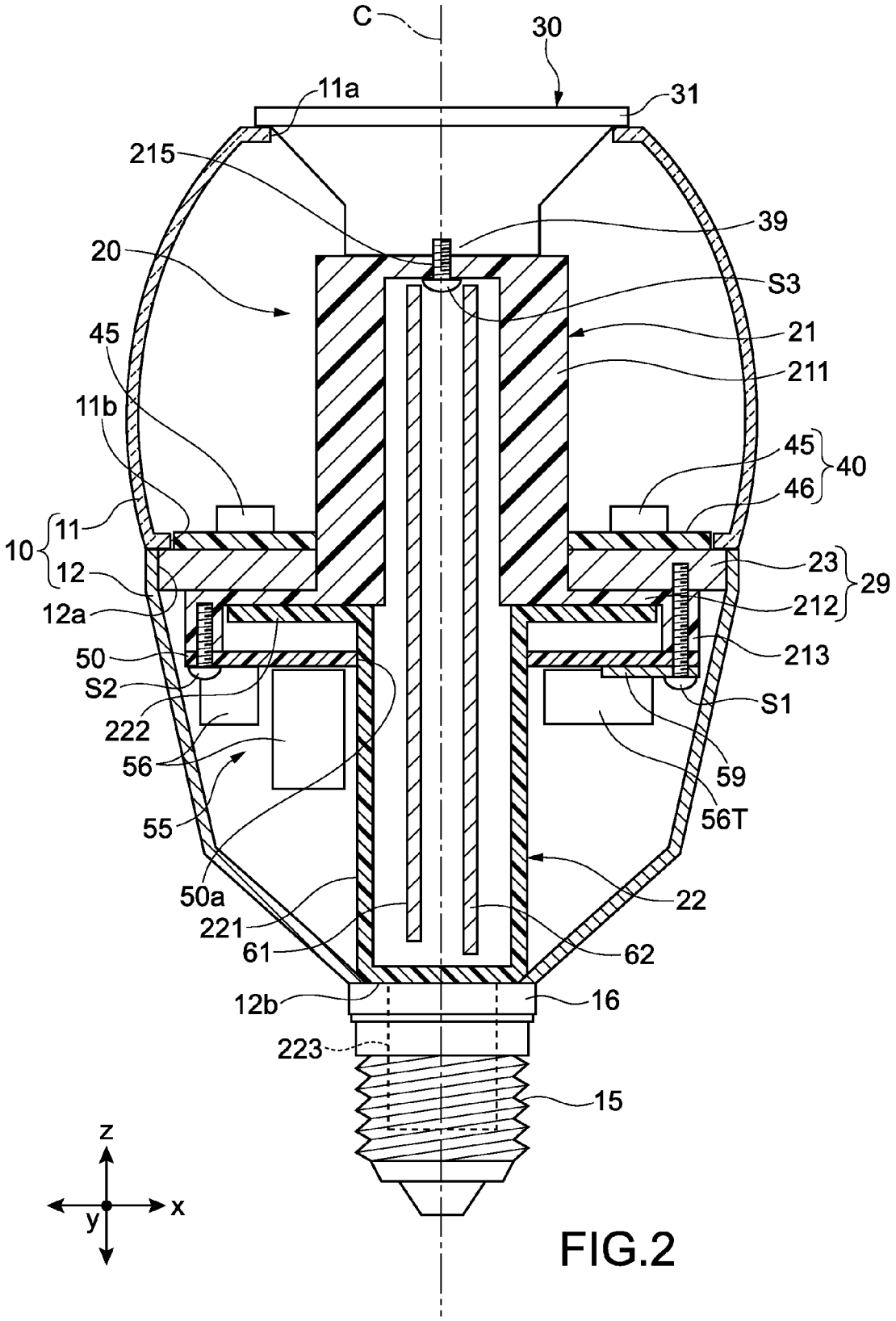
FIG. 2 is a schematic cross-sectional view showing the electric light bulb type light source apparatus shown in FIG. 1.

FIG. 1 is a perspective view showing an electric light bulb type light source apparatus 100 according to an embodiment of the present disclosure. FIG. 2 is a schematic cross-sectional view showing the electric light bulb type light source apparatus 100 shown in FIG. 1. In the following description, the electric light bulb type light source apparatus is simply referred to as a light source apparatus.

The light source apparatus 100 is provided with a casing 10, a light source unit 40 disposed in the casing 10, a speaker 30 provided on one end portion of the casing 10, and a base 15 connected to the other end portion (opposite side to the position of the speaker 30) of the casing 10 with an electrically insulating ring 16 disposed therebetween.

For convenience of explanation, in the following, it is assumed that a direction along a z axis in FIGS. 1 and 2 is a back-and-forth direction of the light source apparatus 100, and specifically, the speaker 30 side corresponds to a front side, and the base 15 side corresponds to a rear side.

The casing 10 has, for example, a base casing 12 and a translucent cover 11 which is attached to the base casing 12. As shown in FIG. 2, the translucent cover 11 has a first opening portion 11*a* formed on an end portion on the front side and a second opening portion 11*b* formed on the opposite side thereto along the z axis direction. The speaker 30 is attached to the translucent cover 11 so as to block the first opening portion 11*a*. On the side of the second opening portion 11*b* of the translucent cover 11, the base casing 12 is provided. The translucent cover 11 is made of glass, acrylic, polycarbonate, or the like.

The light source apparatus 100 is provided with a support unit 20 that supports the speaker 30. The support unit 20 integrally supports the light source unit 40, the speaker 30, and the base 15 so that the speaker 30 and the light source unit 40 is separated from each other, and the light source unit 40 is disposed between the speaker 30 and the base 15. As shown in FIG. 2, typically, the support unit 20 has a heat sink 23, a holding member 21 that is fixed to the heat sink 23 and holds the speaker 30, and a substrate containing box 22 that is disposed so as to be opposed to the holding member 21.

The heat sink 23 of the support unit 20 functions as a chassis of the light source apparatus 100. The heat sink 23 is disposed around a center axis C (see FIG. 2), which is an axis that passes through the center of the speaker 30 along a vibration direction (z axis direction) of a diaphragm 35 (see FIG. 3) included in the speaker 30. The area indicated by the term "around the axis" includes the entire circumference of the axis and a part thereof. Typically, the heat sink 23 has a plate shape and is formed around the entire circumference of the center axis C, that is, formed into a ring shape.

The light source unit 40 is also disposed around the center axis C like the heat sink 23 and is typically formed into a ring shape and disposed on the heat sink 23. For example, the light source unit 40 has a ring-shaped mounting substrate 46 and a plurality of LED (light emitting diode) elements 45 arranged in a ring form on the mounting substrate 46. For one LED element 45, an element that generates white light is used, but an element that generates light of a single color other than white or a plurality of colors may be used.

The heat sink 23 is mainly made of aluminum, for example. However, the heat sink 23 may be made of another metal material such as copper, as long as the material has high thermal conductivity, or may be made of ceramics or resin having a high heat radiation property.

The base 15 is formed so as to be mountable on a socket of a general incandescent light bulb. The base 15 is a member that supplies power to a circuit substrate on which various circuits are mounted, the light source unit 40, and the speaker 30 via a power source circuit 55 to be described later.

The length of the light source apparatus 100 in the z axis direction is 100 to 120 mm, typically about 110 mm. The diameter of the light source apparatus 100 viewed in the z axis direction is 50 to 70 mm, typically about 60 mm.

(Specific Structure of Speaker)

Figure 3:
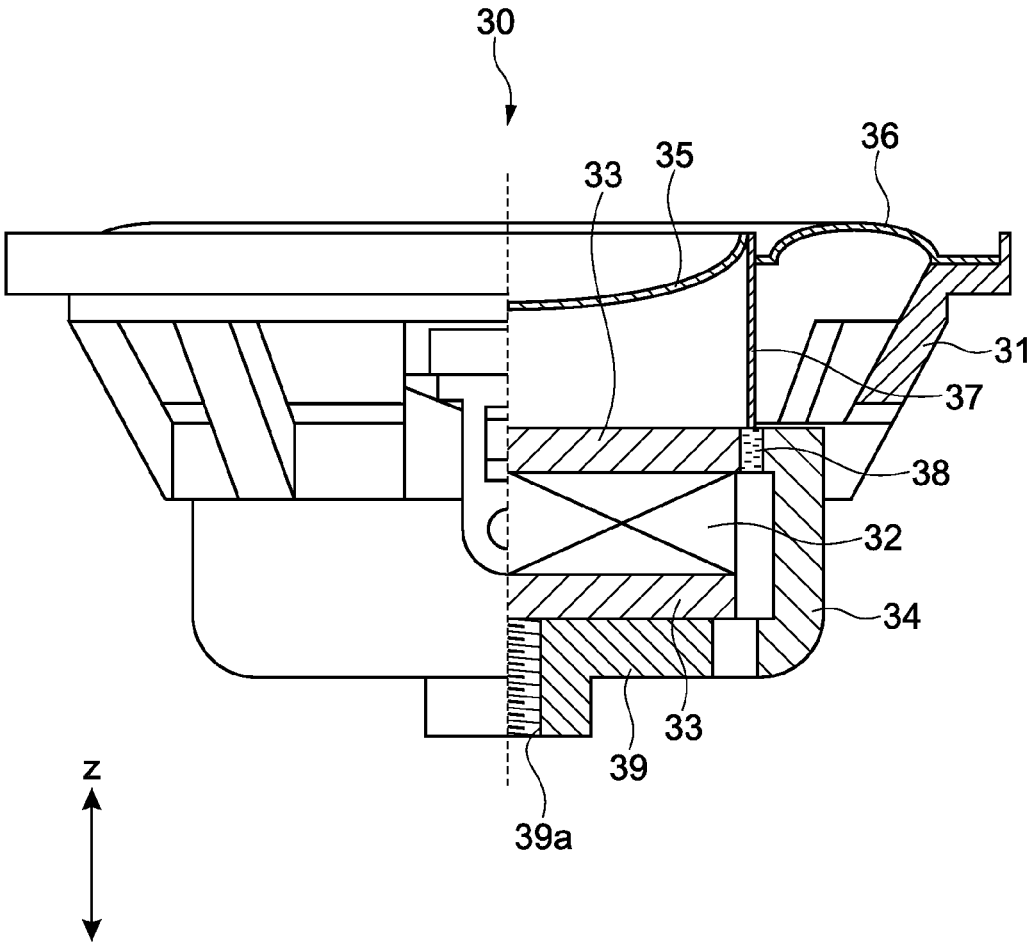
FIG. 3 is a cross-sectional view showing a speaker according to the embodiment.

FIG. 3 is a cross-sectional view showing the speaker 30 according to the embodiment. The speaker 30 is a dynamic type damperless speaker. The speaker 30 is provided with a frame 31, a permanent magnet 32, a plate 33, a yoke 34, the diaphragm 35, an edge 36, a coil bobbin 37, a magnetic fluid 38, and an attachment bottom portion 39.

Instead of a damper in related art, the magnetic fluid 38 is provided in a magnetic gap between the yoke 34 and the plate 33 on the upper side thereof. Further, in the magnetic gap, a voice coil (not shown) is provided. On the attachment bottom portion 39, a threaded hole 39*a* is formed. As will be described later, through the threaded hole 39*a*, the speaker 30 is attached to the holding member 21 of the support unit 20 with a screw S3 (see FIG. 2).

As will be described later, in this embodiment, because the speaker 30 and the light source unit 40 are disposed separately from each other, the speaker 30 is unlikely to be affected by heat of the light source unit 40. Therefore, as the permanent magnet 32 used for the speaker 30, a permanent magnet having a relatively low heat resistance, that is, relatively low demagnetization temperature can be used. For example, a permanent magnet having the demagnetization temperature of 60° C. to 100° C. (inclusive) can be used. As the permanent magnet having the demagnetization temperature of 100° C. or less, neodymium can be used, for example.

The magnetic force of a neodymium magnet is higher than that of a ferrite core magnet or the like, and the demagnetization temperature of the neodymium is about 80° C., which is lower than that of ferrite. In the case where the ferrite core magnet is applied to the speaker 30 of the light source apparatus 100 according to this embodiment, to obtain a magnetic force equivalent to the magnetic force of the neodymium magnet, the size of the ferrite core magnet has to be increased, which is not suitable for the downsizing of the light source apparatus 100. It is also thought that a heat generation quantity of the light source unit 40 is reduced so as not to demagnetize the permanent magnet, but this means that input power to the light source apparatus 100 is suppressed, which reduces a light flux quantity.

In view of the above, in this embodiment, neodymium having a lower heat resistance and a larger magnetic force than ferrite is used, and the speaker 30 and the light source unit 40 is disposed so as to be separated from each other, with the result that the above problem is overcome.

For example, at least a part of the frame 31 of the speaker 30 and at least a part of the edge 36 may be made of a translucent material. As the translucent material, a known material such as an acrylic-based resin material, a polyvinyl-based resin material, and a polyimide-based resin material is used. Thus, light emitted from the light source unit 40 passes through a part of the speaker 30, with the result that it is possible to increase light distribution characteristics leaning to the center of the light source apparatus 100.

(Specific Structure of Support Unit)

Figure 4:
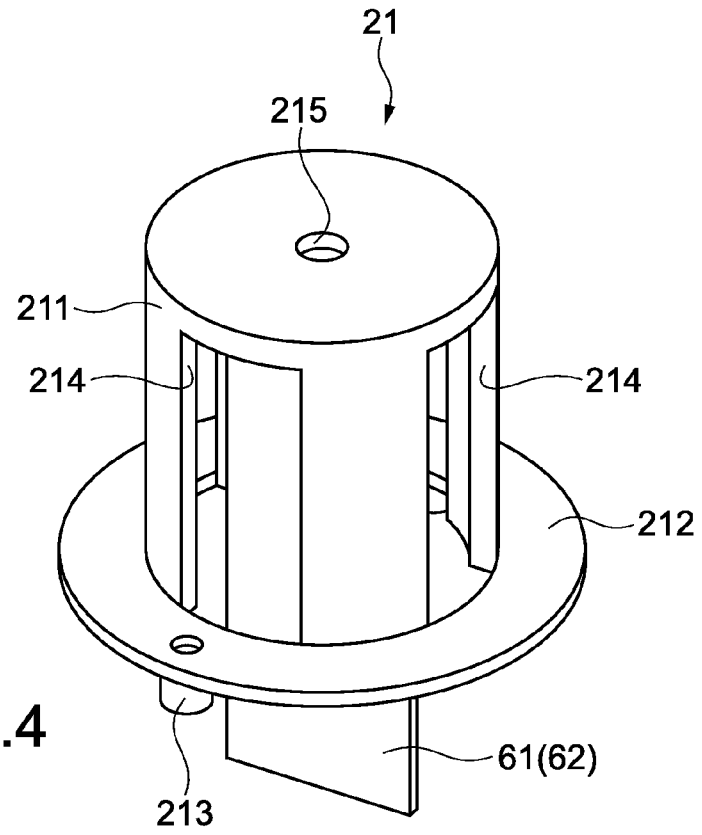
FIG. 4 is a perspective view showing a holding member of a support unit.

FIG. 4 is a perspective view showing the holding member 21 of the support unit 20. The holding member 21 has a tubular portion 211 to which the speaker 30 is attached and a flange portion 212 provided on an end portion on the rear side of the tubular portion 211. The holding portion 21 is disposed in the casing 10 so that the tubular portion 211 passes through the center hole of the heat sink 23 and the light source unit 40, and a longitudinal direction of the tubular portion 211 is extended along the z axis direction.

On an end surface on the front side of the tubular portion 211, a threaded hole 215 is formed. In the threaded hole 215 and the threaded hole 39*a* which is formed in the speaker 30, the screw S3 (see FIG. 2) is screwed. With this structure, the speaker 30 is held by the holding member 21. The way of attaching the speaker 30 to the holding member 21 is not limited to the screwing, and bonding with an adhesive or engagement with an uneven member may be used.

As shown in FIG. 2, the holding member 21 is attached to the heat sink 23 with a screw S1. Specifically, on the flange portion 212 of the holding member 21, an attachment portion 213 for screwing is formed so as to be projected toward the rear side. The heat sink 23 is placed on the flange portion 212, and the holding member 21 is attached to the heat sink 23 through the attachment portion 213 from the back surface side (rear side) of the heat sink 23.

With the structure of the holding member 21 and the heat sink 23 as described above, because the light source unit 40 is disposed separately from the speaker 30 to the rear side thereof as described above, it is possible to suppress the heat influence from the light source unit 40 with respect to the speaker 30. As a result, it is possible to desirably maintain the function of the speaker 30. For example, in the case where the heat influence to the speaker 30 is large, there is a problem in that the demagnetization of the permanent magnet 32 provided to the speaker 30 may occur, but by the light source apparatus 100 according to this embodiment, it is possible to overcome such a problem.

Further, the speaker 30 is disposed on the side from which light of the light source unit 40 is emitted, that is, on a position where the emitted light is shielded. The light source unit 40 is provided in a ring-shaped form, thereby increasing a light distribution angle. Furthermore, the light source unit 40 can emit light with the light distribution as a uniform light quantity with respect to the center axis C.

In this embodiment, the holding member 21 that holds the speaker 30 is disposed so as to be surrounded by the light source unit 40. Therefore, it is possible to reduce the disposition space of the holding member 21 and the light source unit 40 in the electric light bulb type light source apparatus 100, that is, it is possible to increase the disposition density of these members, which can achieve the downsizing of the light source apparatus 100 while ensuring a desired light distribution angle.

To the tubular portion 211 of the holding member 21, a reflection portion that reflects light emitted from the light source unit 40 may be provided. The reflection portion is a part formed of a mirror surface or a material having color with a high light reflectance, for example. The color with the high reflectance refers to white, milky while, or color close to those, for example. Of course, the holding member 21 itself may be formed of a white or milky while resin material. As the resin material, ABS (acrylonitrile butadiene styrene), PBT (polybutylene terephthalate), or the like is used, but another material may be used therefor. The reflection portion may be provided as a member separated from the tubular portion 211 of the holding member 21.

In addition, in the case where the reflection portion is formed of a white or milky white material, for example, the reflection portion can diffusely reflect (scatter) light. Alternatively, when the reflection portion has a reflection surface that is subjected to a blast process, the reflection surface also can diffusely reflect light.

As described above, by providing the reflection portion, it is possible to increase the light distribution angle of light emitted from the light source unit 40 and effectively use light from the light source unit 40, which can increase the illuminance.

Figure 5:
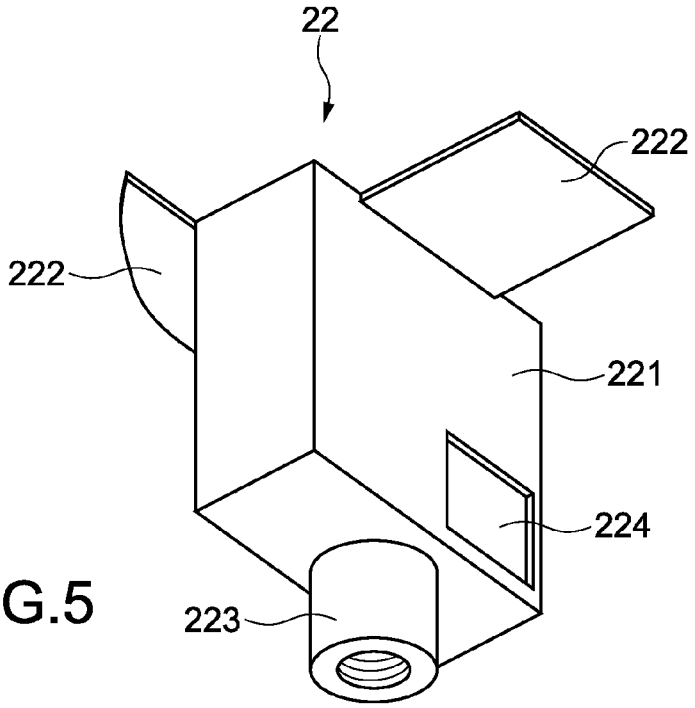
FIG. 5 is a perspective view showing a substrate containing box of the support unit viewed from below.

FIG. 5 is a perspective view showing the substrate containing box 22 of the support unit 20 viewed from below. The substrate containing box 22 has a main body 221, a plurality of contact plates 222, and a projection portion 223. The contact plates 222 are projected in a direction perpendicular to the z axis from the main body 221, and the projection portion 223 is projected in the z axis direction from the main body 221. In FIG. 5, the plurality of contact plates 222 having different shapes are provided, but only one contact plate 222 may be provided.

Further, in the main body 221, a connection hole portion 224 to which a connector for conduction (not shown) is connected is formed. A plurality of connection hole portions 224 may be formed.

As shown in FIG. 2, the main body 221 is uprightly provided along the z axis direction, and the holding member 21 and the substrate containing box 22 are disposed in the casing 10 so as to be opposed to each other so that the contact plates 222 are in contact with the flange portion 212 of the holding member 21. In an area formed in the holding member 21 and the substrate containing box 22 disposed as described above, that is, in an area in the tubular portion 211 and the main body 221, the circuit substrates are disposed. A plurality of, e.g., two circuit substrates are provided (drive substrate 61 and control substrate 62). As will be described later, the drive substrate 61 is provided as a common substrate on which an LED drive circuit 614 and an audio amplifier (AMP) 613 (see FIG. 7) to be described later are mounted.

The projection portion 223 is disposed in the base 15 so as to be inserted in an opening end portion 12*b* on the rear side of the base casing 12, as shown in FIG. 2. The projection portion 223 is formed in a tubular form and disposed so that a lead (not shown) that connects a terminal of a top portion of the base 15 and a power source substrate 50 to be described later with each other passes through the inside of the projection portion 223.

Like the holding member 21, the substrate containing box 22 is formed of a nonconductive material, for example, an ABS resin material mainly. In this way, a desirable material as an electrically insulating material and a fire-retardant material is used for the holding member 21 and the substrate containing box 22.

In the tubular portion 211 of the holding member 21, a plurality of openings 214 are formed. As a result, in the casing 10, via the openings 214, an external area of the tubular portion 211 of the holding member 21 is communicated with an area in the tubular portion 211 and the substrate containing box 22. With this structure, in the casing 10, it is possible to use not only the external area of the tubular portion 211 but also the area in the tubular portion 211 and the substrate containing box 22 as an enclosure of the speaker 30. As a result, the volume of the enclosure becomes larger, which improves the sound quality of the speaker 30. It should be noted that only one opening 214 may be formed in the tubular portion 211.

The base casing 12 is formed of a material having relatively high thermal conductivity, for example, mainly aluminum. As a material of the base casing 12, any other metal material such as copper may be used as long as the material has high thermal conductivity. Alternatively, a material of the base casing 12 may be resin having a high heat radiation property or ceramics. The heat sink 23 and the base casing 12 are thermally connected with each other. As shown in FIG. 2, for example, an opening end portion 12*a* formed on the base casing 12 and a side surface of the heat sink 23 are in contact with each other directly or through a heat conductive sheet or the like, thereby causing heat conduction between the members. As a result, heat generated from the light source unit 40 is efficiently radiated to the outside via the heat sink 23 and the base casing 12. It should be noted that the heat sink 23 and the base casing 12 may be formed of different main materials.

With reference to FIG. 2, the translucent cover 11 is disposed with respect to the base casing 12 so that an opening surface of the opening end portion 12*a* of the base casing 12 and an opening surface of the second opening portion 11*b* of the translucent cover 11 face each other. The support unit 20 supports the speaker 30 so that the translucent cover 11 is pressed against the heat sink 23 with the speaker 30, and the speaker 30 and the support unit 20 sandwich the translucent cover 11.

The heat sink 23 mainly forms a base portion 29 of the support unit 20. The base portion 29 of the support unit 20 includes the flange portion 212 of the holding member 21. Further, the base portion 29 of the support unit 20 may include the base casing 12.

As described above, the speaker 30 supported by the support unit 20 sandwiches the translucent cover 11 with the heat sink 23 and supports the translucent cover 11 with the translucent cover 11 pressed against the heat sink 23. Thus, it is not necessary to directly fix the translucent cover 11 to the heat sink 23 and the speaker 30. Therefore, even if the translucent cover 11 having a thermal expansion coefficient different from the thermal expansion coefficients of the heat sink 23 and (the frame 31 of) the speaker 30 is thermally expanded due to a temperature change of the light source unit 40, deformation due to the thermal expansion at the opening portions 11*a* and 11*b* that face the speaker 30 and the heat sink 23, respectively, is tolerated, and it is possible to let a stress of the thermal expansion get away. Thus, it is possible to suppress such an accident that a mechanical stress is generated in the translucent cover 11, and the translucent cover 11 deteriorates.

(Structures of Various Circuit Substrates)

As shown in FIG. 2, in the base casing 12, the power source substrate 50 on which the power source circuit 55 is mounted is contained. The power source substrate 50 is attached to the holding member 21 with a screw S2. Further, with the screw S1 that connects the holding member 21 and the heat sink 23 with each other, the power source substrate 50 is also attached to the heat sink 23.

Here, in general, in the viewpoint of suitability of an LED light bulb to a lighting apparatus, the shape of the LED light bulb is desired to be close to the shape of an incandescent light bulb, and the LED light bulb is desired to be downsized as much as possible. If a product size of the LED light bulb is significantly large, the quality of the product is degraded. In the case where the power source substrate and a drive circuit substrate of the LED are disposed on the same plane or disposed along a parallel plane, the product size is increased, and an outer circumferential size of a casing in the vicinity of a base is also increased. In the viewpoint of the suitability to a lighting apparatus, it is ideal to achieve an LED light bulb having the outer circumferential size of the casing in the vicinity of the base which is close to that of the incandescent light bulb. Therefore, in such a viewpoint, a product in which the power supply substrate and another circuit substrate are disposed on the same plane as described above leads to the degradation of the quality of the product. In view of this, in the present disclosure, the circuit substrates are disposed as follows.

Figure 6:
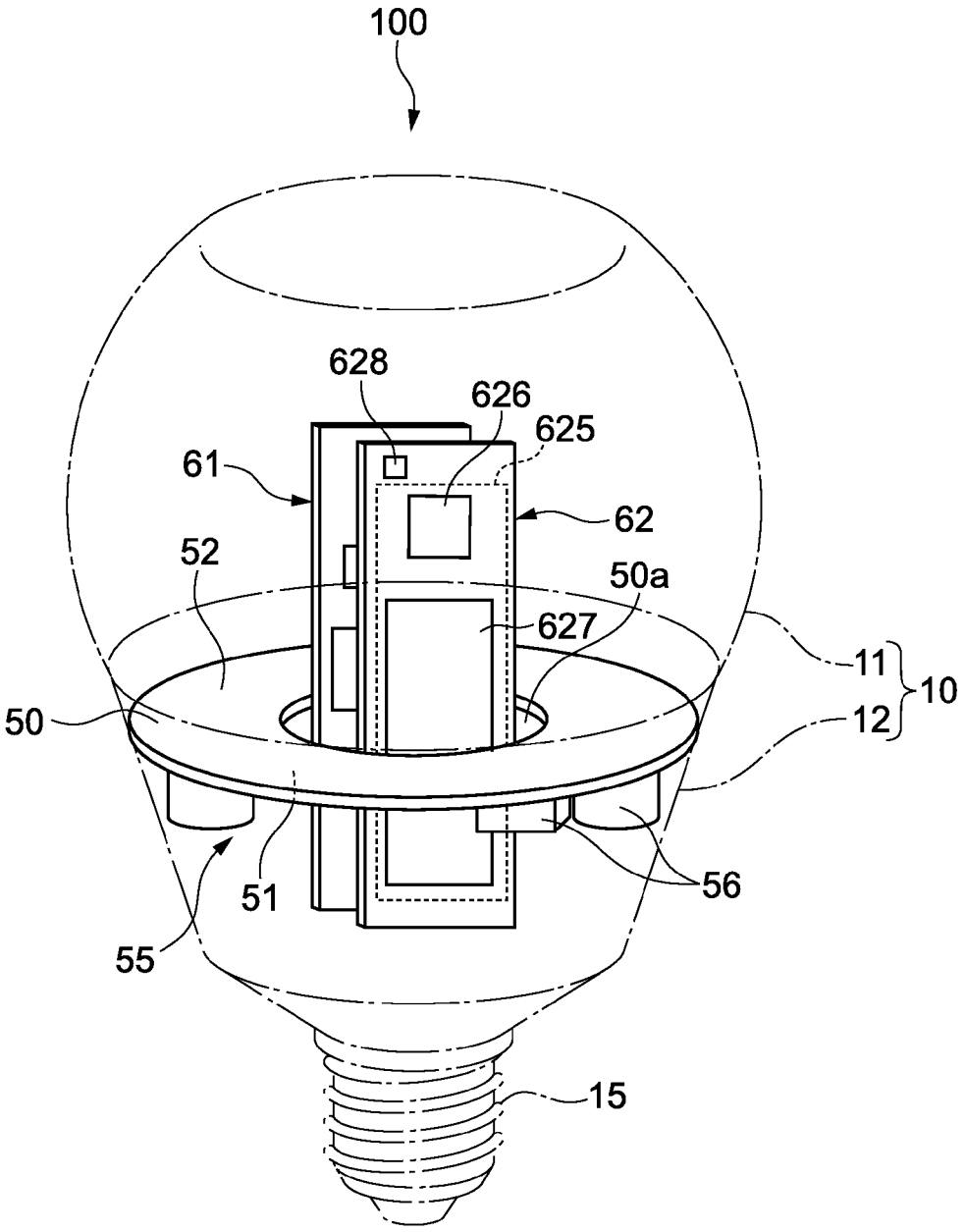
FIG. 6 is a diagram showing a disposition relationship between a power source substrate and other substrates (drive substrate and control substrate)

FIG. 6 is a diagram showing a disposition relationship between the power source substrate 50 and other substrates (drive substrate 61 and control substrate 62 as described above). The power source substrate 50 has a through hole 50*a*, and the drive substrate 61 and the control substrate 62 are partly disposed in the through hole 50*a*.

In other words, the power source substrate 50 is formed into a ring shape. Specifically, as shown in FIG. 2, in the through hole 50*a*, the main body 221 of the substrate containing box 22 is inserted. As a result, the drive substrate 61 and the control substrate 62 disposed in the holding member 21 and the substrate containing box 22 are disposed so as to perpendicularly cross the power source substrate 50 through the through hole of the power source substrate 50.

As described above, the drive substrate 61 and the control substrate 62 are disposed so as to be inserted in the through hole of the power source substrate 50, so it is possible to efficiently dispose components in the small containing space of the casing 10 and achieve the downsizing of the light source apparatus 100.

Specifically, an envelope shape of the entire substrates disposed as described above approaches the shape obtained by disposing two schematic triangular shapes oppositely to each other along the z axis direction. The shape approaches an outline of the casing 10 in which the base casing 12 and the translucent cover 11 are fitted when the light source apparatus 100 is viewed from the side. That is, by disposing the substrates 50, 61, and 62 as described above, it is possible to increase the density of the components in the casing 10, which can achieve the downsizing of the light source apparatus 100.

Further, it is possible to densely dispose the substrates 50, 61, and 62 in the casing 10, so the volume of the speaker 30 as the enclosure can be sufficiently ensured, which can improve the sound quality of the speaker 30.

As shown in FIG. 6, on the control substrate 62, a receiving unit (or light receiving unit) 628, an antenna 626, and a network control circuit 627 are mounted.

The receiving unit 628 receives an infrared signal transmitted from a remote controller (not shown) which can be used by a user. The position and posture of the control substrate 62 are set so that the receiving unit 628 is disposed on a position where the infrared signal can be received, that is, disposed in an area (area on the front side of the light source unit 40) in the translucent cover 11 in the casing 10. For example, the receiving unit 628 is mounted on an end portion on the front side of the control substrate 62. The remote controller (not shown) is an apparatus that generates signals for turning-on and -off, dimming, and toning of the light source unit 40, and the like.

Typically, the antenna 626 is an antenna for near field communication such as Bluetooth. Further, the network control circuit 627 is compliant with the communication standard. The position and posture of the drive substrate 61 are set so that the antenna 626 is disposed on a position where a radio signal can be received, that is, disposed in an area (area on the front side of the light source unit 40) in the translucent cover 11 in the casing 10. For example, an AV (audio video) apparatus serving as an apparatus to be operated by the user transmits a radio signal, and the antenna 626 receives the radio signal. For example, the signal transmitted from the AV apparatus is a signal of a sound volume of sound from the speaker 30, reproduction and stop thereof, and the like. As the AV apparatus, a portable apparatus may be used.

It should be noted that the antenna 626 and the network control circuit 627 may be compliant with the communication standard for constructing WiFi (wireless fidelity), ZigBee, a wireless LAN (local area network), or the like, in addition to Bluetooth.

The power source substrate 50 has a first surface 51 that is opposed to the base 15 side and a second surface 52 that is opposed to the light source unit 40 side. Further, the power source circuit 55 mounted on the power source substrate 50 has a transformer 56T (see FIG. 2) including a primary side coil and a secondary side coil and a primary side electronic component 56 electrically connected to the primary side coil. The transformer 56T and the primary side electronic component 56 are mounted on the first surface 51 of the power source substrate 50.

As described above, the transformer 56T and the primary side electronic component 56 each having a relatively large size are disposed on the base 15 side of the power source substrate 50, thereby making it possible to dispose a component different from the power source circuit 55, for example, a part of the light source unit 40 and the support unit 20 in a space on the front side of the second surface 52. As a result, it is possible to effectively use a small space in the casing 10 (or base casing 12).

(Electrical Structure of Light Source Apparatus)

Figure 7:
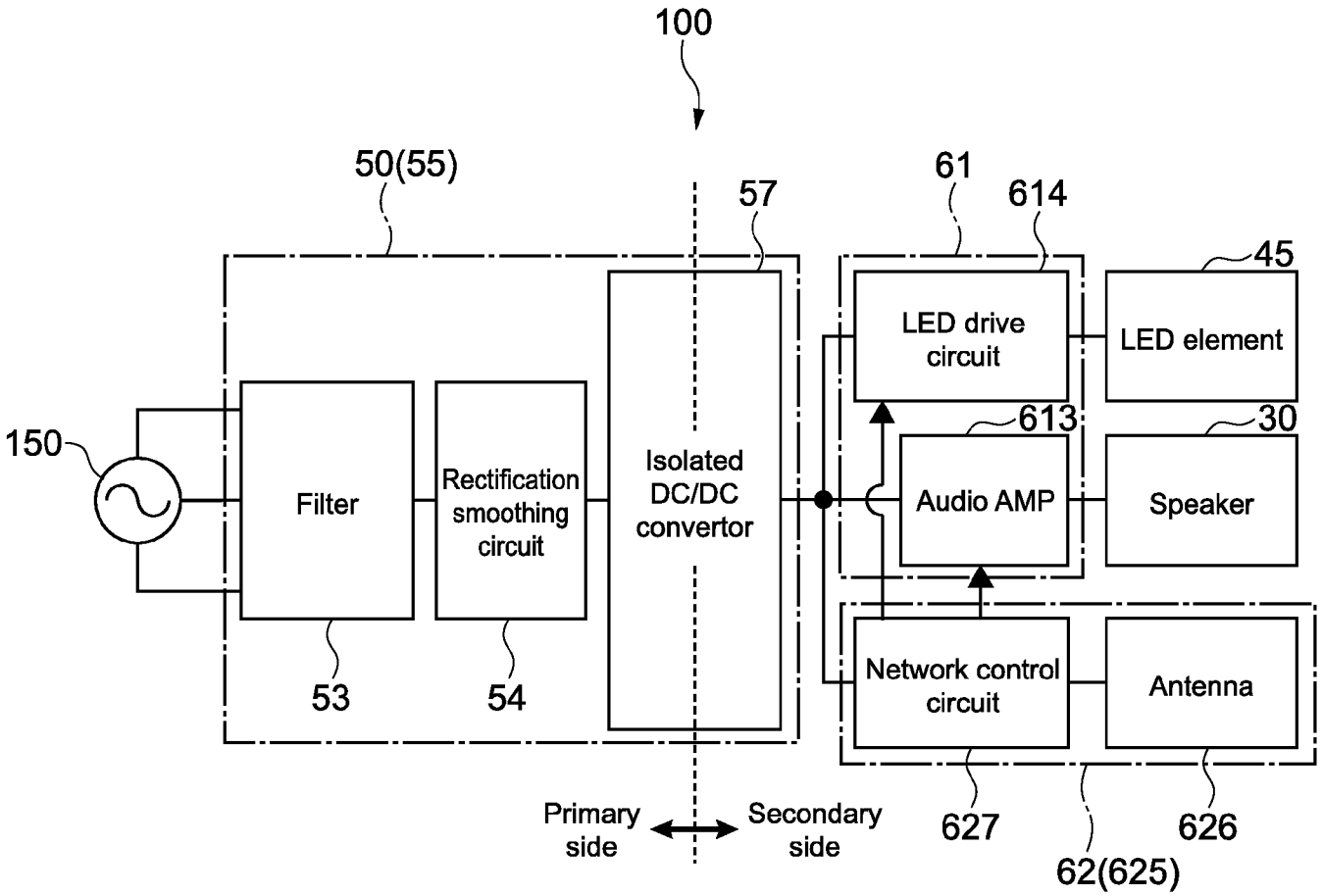
FIG. 7 is a block diagram showing an electrical structure of the light source apparatus.

FIG. 7 is a block diagram showing an electrical structure of the light source apparatus 100. The light source apparatus 100 is provided with a filter 53, a rectification smoothing circuit 54, an isolated DC/DC converter 57, the LED drive circuit 614, the audio AMP 613, the network control circuit 627, and the antenna 626. A commercial power source 150 supplies power to the power source circuit 55 via the base 15 of the light source apparatus 100.

The filter 53, the rectification smoothing circuit 54, and the isolated DC/DC converter 57 are the power source circuits 55 and are mounted on the power source substrate 50 as described above. The isolated DC/DC converter 57 includes the transformer 56T. For the power source circuit 55, the isolated DC/DC converter 57 is used to electrically insulate the primary side circuit and the secondary side circuit from each other.

The LED drive circuit 614 and the audio AMP 613 are mounted on the drive substrate 61 as described above. The LED drive circuit 614 performs control for turning-on and -off, dimming, and toning of the light source unit 40, and the like. The audio AMP 613 is the drive circuit of the speaker 30 and controls a sound volume of sound from the speaker 30, reproduction and stop thereof, and the like.

As described above, the network control circuit 627 and the antenna 626 are a part of a control circuit 625 and are mounted on the control substrate 62. On the basis of a signal received via the receiving unit 628 and the antenna 626, the network control circuit 627 outputs information relating to the content of the signal received to the LED drive circuit 614 and the audio AMP 613.

(Structure of Ground Connection of Electric Circuit)

As shown in FIG. 2, on the first surface 51 of the power source substrate 50, a secondary side ground connection pattern 59 is formed. The ground connection pattern 59 is conducted with the heat sink 23 and the base casing 12 via the screw S1. That is, the heat sink 23 and the base casing 12 serve as electrical grounds for the power source circuit 55.

As described above, in this embodiment, the insulating power source circuit is used, and the secondary side circuit thereof is grounded. Therefore, it is possible to obtain an appropriate EMS (electromagnetic susceptibility) without generating an EMI (electromagnetic interference) or the like, with the result that the condition of an EMC (electromagnetic compatibility) can be satisfied. In other words, according to the present technology, it is possible to suppress the leakage of high frequency noises from the drive substrate 61 or the like and suppress the leakage of radiation noises from the speaker 30. Further, it is of course possible to suppress exogenous noises from entering the base casing 12.

Further, in this embodiment, members that form a ground potential are the heat sink 23 and the base casing 12 that function as the heat radiation members. That is, the heat sink 23 and the base casing 12 are each equipped with the functions of the heat radiation and the ground potential formation, and therefore it is unnecessary to provide an additional ground member, which contributes to the downsizing of the light source apparatus 100.

By carrying out the EMC countermeasure as described above with respect to the light source apparatus 100, it is possible to apply the light source apparatus 100 to a so-called smart house.

Other Embodiments

The present disclosure is not limited to the above embodiment, and various other embodiments can be implemented.

In the above embodiment, the light source unit 40 on which the LED element 45 that has the point light emission function is mounted is used as an example. The light source unit is not limited to this and may be, for example, an organic or inorganic EL (electro luminescence) element, that is, a light source unit having a surface light emission function, or a fluorescent lamp such as a CCFL (cold cathode fluorescent lighting (lamp)) having a three dimensional light emission function.

Further, the light source unit 40 has the ring shape but may have a polygonal shape having three or more sides or a linear shape (one or more linearly formed shapes). The power source substrate 50 may also have another shape in the same meanings.

In the above embodiment, the damperless speaker is used as an example of the speaker 30, but a general type speaker 30 with no magnetic fluid 38 may be used.

Instead of the through hole of the power source substrate 50, a cutout may be formed on the power source substrate 50. Alternatively, the power source substrate 50 may be formed with both the through hole and the cutout. In this case, the power source substrate 50 is formed into a C-letter shape. Alternatively, the power source substrate 50 may be formed into a half-ring shape.

In the above embodiment, on one drive substrate 61, the drive circuits of the light source unit 40 and the speaker 30 are mounted, but those may be mounted on separate circuit substrates. Further, in the case where the those drive circuits are mounted on separate circuit substrates as mentioned above, at least one of the two circuit substrates only has to include a part disposed in the through hole 50*a* or the cutout of the power source substrate 50.

In the above embodiment, the drive substrate 61 and the control substrate 62 are provided as different substrates, but those may be provided as a common substrate.

In the above embodiment, the receiving unit 628 for the infrared signal is mounted on the control substrate 62 but may be mounted on the drive substrate 61. Alternatively, it is not always necessary to provide the receiving unit 628 for the infrared signal from the remote controller.

In the above embodiment, the power source substrate 50 and the other substrates are provided so as to cross each other perpendicularly. However, those may be provided so as to cross each other not perpendicularly but obliquely.

The light source apparatus according to the above embodiment is provided with the speaker but may be provided with another device instead of the speaker, such as an image sensor, an optical sensor, an ultrasonic sensor, a radiation sensor, and a temperature sensor.

Out of the characteristic parts of the embodiments described above, at least two characteristic parts can be combined. It should be noted that the present disclosure can take the following configurations:

(1) An electric light bulb type light source apparatus, including:

a light source unit;

a power source substrate on which a power source circuit is mounted and which has one of a through hole and a cutout;

a drive substrate on which a drive circuit of at least the light source unit is mounted and which includes a part disposed in the one of the through hole and the cutout of the power source substrate;

a base used to supply power to the power source substrate; and a casing configured to contain the light source unit, the power source substrate, and the drive substrate, the casing having a translucent cover.

(2) The electric light bulb type light source apparatus according to Item (1), further including:

a speaker; and a speaker drive substrate on which a drive circuit of the speaker is mounted and which is contained in the casing and includes a part disposed in the one of the through hole and the cutout of the power source substrate.

(3) The electric light bulb type light source apparatus according to Item (2), in which the speaker drive substrate and the drive substrate are provided as a common substrate so that the drive circuit of the speaker is mounted on the drive substrate.

(4) The electric light bulb type light source apparatus according to any one of Items (1) to (3), further including a control substrate on which a control circuit that receives a radio signal from an outside of the electric light bulb type light source apparatus is mounted and which is contained in the casing and includes a part disposed in the one of the through hole and the cutout of the power source substrate.

(5) The electric light bulb type light source apparatus according to Item (4), in which the control substrate and the drive substrate are provided as a common substrate so that the control circuit is mounted on the drive substrate.

(6) The electric light bulb type light source apparatus according to any one of Items (1) to (5), further including a support unit configured to support the light source unit and the power source substrate so that the power source substrate is disposed between the light source unit and the base, the support unit including a part disposed in the one of the through hole and the cutout of the power source substrate.

(7) The electric light bulb type light source apparatus according to Item (6), in which the power source substrate includes a first surface opposed to the base and a second surface which is provided on an opposite side to the first surface and opposed to the light source unit, the power source circuit includes a transformer including a primary side coil and a secondary side coil and a primary side electronic component electrically connected to the primary side coil, and the transformer and the primary side electronic component are mounted on the first surface of the power source substrate.

(8) The electric light bulb type light source apparatus according to any one of Items (1) to (7), further including a receiving unit configured to receive an infrared signal transmitted from a remote controller used by a user, the receiving unit being mounted on the drive substrate.

(9) The electric light bulb type light source apparatus according to any one of Items (1) to (8), in which the drive substrate is disposed to cross the power source substrate via the one of the through hole and the cut out of the power source substrate.

(10) The electric light bulb type light source apparatus according to any one of Items (1) to (9), in which the light source unit includes one of an LED (light emitting diode) and an EL (electro luminescence) element as a light source element.

(11) An electric light bulb type light source apparatus, including:

a light source unit;

a power source substrate on which a power source circuit is mounted and which has one of a through hole and a cutout;

a drive substrate on which a drive circuit of at least the light source unit is mounted;

a speaker;

a speaker drive substrate including a part disposed in the one of the through hole and the cutout of the power source substrate;

a base used to supply power to the power source substrate; and a casing configured to contain the light source unit, the power source substrate, the drive substrate, and the speaker drive substrate, the casing having a translucent cover.

(12) The electric light bulb type light source apparatus according to Item (11), in which the speaker drive substrate and the drive substrate are provided as a common substrate so that a drive circuit of the speaker is mounted on the drive substrate.

It should be understood by those skilled in the art that various modifications, combinations, sub-combinations and alterations may occur depending on design requirements and other factors insofar as they are within the scope of the appended claims or the equivalents thereof.

What is claimed is:

1. An electric light source apparatus, comprising:

a light source unit;

a speaker;

a power source substrate on which a power source circuit is mounted and which has one of a through hole and a cutout;

a drive substrate on which a drive circuit of at least said light source unit is mounted and which includes a part disposed in said one of said through hole and said cutout of said power source substrate;

a base used to supply power to said power source substrate; and a casing configured to contain said light source unit, said power source substrate, said speaker, and said drive substrate, said casing having a translucent cover, wherein said translucent cover comprises an opening portion formed on an end portion of said translucent cover;

said speaker is attached to said translucent cover such that said speaker blocks said opening portion; and said speaker and said light source unit are disposed separately from each other, wherein said power source substrate includes a first surface opposed to said base and a second surface which is provided on an opposite side to said first surface and opposed to said light source unit, said power source circuit includes a transformer including a primary side coil and a secondary side coil and a primary side electronic component electrically connected to said primary side coil, and said transformer and said primary side electronic component are mounted on said first surface of said power source substrate.

2. The electric light source apparatus according to claim 1, further comprising:

a speaker drive substrate on which a drive circuit of said speaker is mounted and which is contained in said casing and includes a part disposed in said one of said through hole and said cutout of said power source substrate.

3. The electric light source apparatus according to claim 2, wherein said speaker drive substrate and said drive substrate are provided as a common substrate so that said drive circuit of said speaker is mounted on said drive substrate.

4. The electric light source apparatus according to claim 1, further comprising a control substrate on which a control circuit that receives a radio signal from an outside of said electric light source apparatus is mounted and which is contained in said casing and includes a part disposed in said one of said through hole and said cutout of said power source substrate.

5. The electric light source apparatus according to claim 4, wherein said control substrate and said drive substrate are provided as a common substrate so that said control circuit is mounted on said drive substrate.

6. The electric light source apparatus according to claim 1, further comprising a receiving unit configured to receive an infrared signal transmitted from a remote controller used by a user, said receiving unit being mounted on said drive substrate.

7. The electric light source apparatus according to claim 1, wherein said drive substrate is disposed to cross said power source substrate via said one of said through hole and said cutout of said power source substrate.

8. The electric light source apparatus according to claim 1, wherein said light source unit includes one of an LED (light emitting diode) and an EL (electro luminescence) element as a light source element.

9. The electric light source apparatus according to claim 1, further comprising a support unit configured to support said light source unit and said power source substrate so that said power source substrate is disposed between said light source unit and said base, said support unit including a part disposed in said one of said through hole and said cutout of said power source substrate.

10. The electric light source apparatus according to claim 9, wherein said support unit separates said light source unit with said speaker.

* * * * *